US009027197B1

(12) United States Patent
Gao

(10) Patent No.: US 9,027,197 B1
(45) Date of Patent: May 12, 2015

(54) DUSTPAN

(71) Applicant: Jun Gao, Livingston, NJ (US)

(72) Inventor: Jun Gao, Livingston, NJ (US)

( * ) Notice: Subject to any disclaimer, the term of this patent is extended or adjusted under 35 U.S.C. 154(b) by 0 days.

(21) Appl. No.: 14/546,908

(22) Filed: Nov. 18, 2014

Related U.S. Application Data

(60) Provisional application No. 61/906,180, filed on Nov. 19, 2013.

(51) Int. Cl.
*A47L 13/52* (2006.01)

(52) U.S. Cl.
CPC ..... *A47L 13/52* (2013.01)

(58) Field of Classification Search
CPC ..... A47L 13/52
USPC ..... 15/257.1–257.9
See application file for complete search history.

(56) References Cited

U.S. PATENT DOCUMENTS

| | | | | |
|---|---|---|---|---|
| 1,053,438 | A * | 2/1913 | Resch | 15/257.3 |
| 4,562,611 | A | 1/1986 | Marttinen | |
| 4,709,440 | A * | 12/1987 | Conelly | 15/257.3 |
| 6,233,780 | B1 | 5/2001 | Mead | |
| 6,732,402 | B1 * | 5/2004 | Hsu | 15/257.6 |
| 6,925,678 | B2 | 8/2005 | Libman | |
| 2003/0167588 | A1 | 9/2003 | Perelli et al. | |

FOREIGN PATENT DOCUMENTS

| | | |
|---|---|---|
| FR | 773180 | * 11/1934 |
| JP | 9-24011 | * 1/1997 |
| JP | 9-187412 | * 7/1997 |

* cited by examiner

*Primary Examiner* — Mark Spisich
(74) *Attorney, Agent, or Firm* — Michael J. Brown

(57) ABSTRACT

An upright dustpan is disclosed which allows a user to open and close a door of a dust collecting compartment through a trigger on the handle. A trigger activates an actuating arm, which in turn causes the movement of an actuating pin that is connected to an external arm which opens the compartment door. The movement of the actuating pin may be lateral or rotational, providing different movement to the external arm.

8 Claims, 3 Drawing Sheets

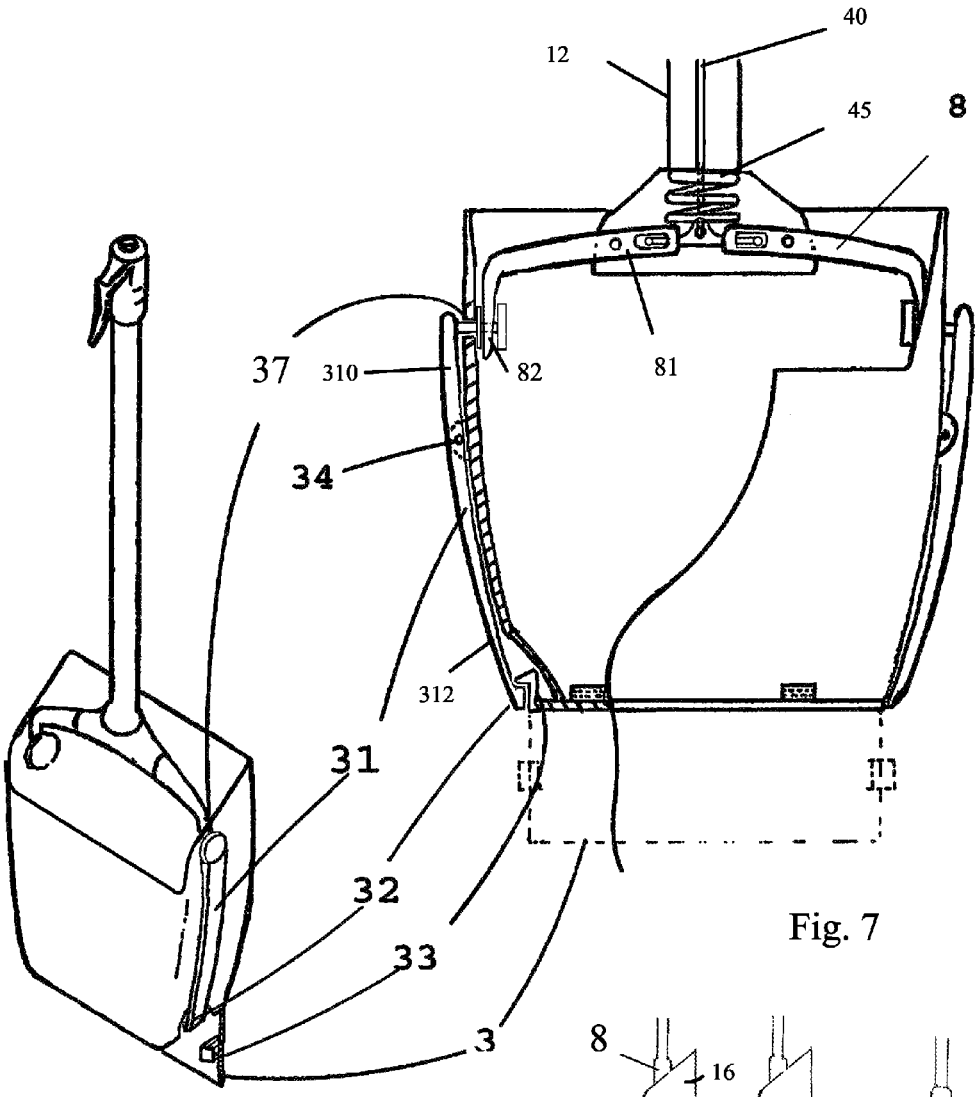
Fig. 6
Fig. 7
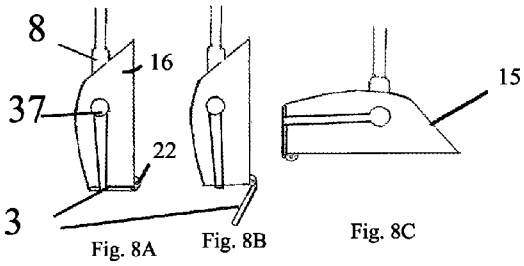
Fig. 8A Fig. 8B Fig. 8C

DUSTPAN

This application claims priority from U.S. provisional patent application No. 61/906,180, filed Nov. 19, 2013.

FIELD OF INVENTION

The present invention is in the field of household cleaning devices.

BACKGROUND

A dustpan is a device that is commonly used to manually clean household or commercial debris with a broom. It has an open edge for debris to be swept into a compartment that can hold the debris. One particular type of dustpan is upright type, usually with an elongated handle. It allows a user to reposition the dust pan while standing up without reaching for the floor. The compartment of such device can swing freely around a horizontal shaft member held by a vertical handle; the center of gravity of the compartment is designed to be lower than the horizontal shaft around which the dust compartment pivots, gravity returns the compartment to vertical position with the opening facing up. This function reduces the likelihood that dust gets out of receptacle as well as the footprint of such a device.

The advance in new design technologies has brought about a plethora of household waste storage designs that features compact foot print. Designs that can be tucked away in corners, between cabinetry walls, under kitchen sinks and etc. have become popular. When an upright type of dustpan is used in conjunction with many of the modern designs of waste receptacles, many of drawbacks are manifested when a person try to empty an upright dustpan into a waste receptacle.

One drawback of the upright type of dustpan is when a user empties it, the person would have to use both hands, one hand for holding the handle and the other hand for holding the dust compartment itself, to overcome the gravity pull of the dust compartment. Under commercial circumstances when a user tries to empty such a device into a large curb side waste bin with cover, the user has to remove the cover or reach deep into the waste bin to flip the dust compartment.

Another drawback shows itself when a person tries to empty the dustpan into a receptacle located in a small space, notable with many new designs of waste receptacles that are designed to fit into such small spaces. The handle of the waste bin can prevent dust bin compartment from turning past sufficient angle to allow the compartment to face downward. Under circumstances where space to maneuver the long handle is limited, the dust compartment could have difficulty to turn downward to be emptied.

Yet another drawback is when emptying fine dusts, current upright dustpans, especially those with elongated handles, cannot be lowered deep into the waste receptacle, thus make it easy for dust to be airborne.

The primary object of the present invention is to shorten the time and lessen the effort needed to empty an upright type dustpan and provide a clean and smooth way to do so. Prior art dustpans discussed below have shortcomings and do not address all of the concerns stated above.

U.S. Pat. No. 6,233,780 B1 to Raymond Mead discloses a rear-opening dustpan, which is not an upright type. The disclosed invention does not provide the convenience that an upright type dustpan gives.

U.S. Pat. No. 4,562,611 A to Alpo L. Marttinen discloses a handled pan with dumping function. The disclosed design however does not prevent dust from spilling while a user carries and walk with it, neither does it make emptying into covered waste receptacles easier.

US 20030167588 A1 to Scott Juergens and Thomas Perelli discloses a long-handled cleaning dust pan with a ramp to facilitate pulling of waste into the compartment.

U.S. Pat. No. 6,925,678 B2 to Robert J. Libman discloses a dust pan with both an elongate handle and a receptacle for a removable long handle.

None of the aforementioned inventions and arts in single or combination offers the solutions of the present invention.

SUMMARY OF THE INVENTION

The purpose of the invention is to address aforementioned drawbacks of existing upright dustpans. The invention provides an upright dustpan with an actuating member, with which a user can use one hand to engage, thus eliminating the need to manually flip the dustpan compartment with another hand. The invention allows the dustpan to be lowered low into waste bin to mitigate airborne dust.

The invention has an elongated handle with a hollow interior, the lower part of which has a horizontal axial member that holds dust compartment. The upper part of the handle is attached to a controlling member through which at least one door of the said dustpan can be opened and closed, while the lower part of the handle still allows the dust compartment to pivot.

The dust compartment is a hollow compartment with an enclosed space surrounded by a wall or walls. The compartment has a rear wall, which when the compartment pivots to a vertical orientation, is oriented downward. There is at least one door at the rear wall capable of opening or closing to allow the content of the compartment to drop or to be retained within the compartment. The rear wall of the compartment may also be a door.

The controlling member in the upper handle is connected through the hollow interior of the elongated handle to at least one means that actuates the door in the rear wall of the compartment, preferably by a person using the dustpan with only one hand. The actuating means also provides for retaining the door in the rear wall of the compartment from opening. Preferably, the rear door of the compartment can be locked so weight of the debris within the compartment does not open the door.

Yet another objective of the invention is to lock the angle of the dustpan compartment relative to the handle and lock the angle when a person using the dustpan has released the actuator. The angle may be locked through at least one detent blocking the compartment from pivoting around said horizontal member of the elongated handle when control for such pivoting is not engaged.

Yet another objective of the invention is to have gravity pull the dustpan into perpendicular orientation so debris falls down through the opening of the compartment, even in constricted spaces such as the inside of covered waste receptacles.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Other aspects, features, and advantages of the present invention will become more fully apparent from the following detailed description, the appended claim, and the accompanying drawings in which similar elements are given similar reference numerals.

BRIEF DESCRIPTION OF THE DRAWINGS

FIG. 6 is a perspective view of an alternate embodiment of the present invention.

FIG. 7 is a cut-away view of the embodiment shown in FIG. 6.

FIGS. 8A to 8C are side view of the embodiment shown in FIG. 6, showing the door in different positions and orientations.

DETAILED DESCRIPTION OF THE PREFERRED EMBODIMENT

Figure 1:
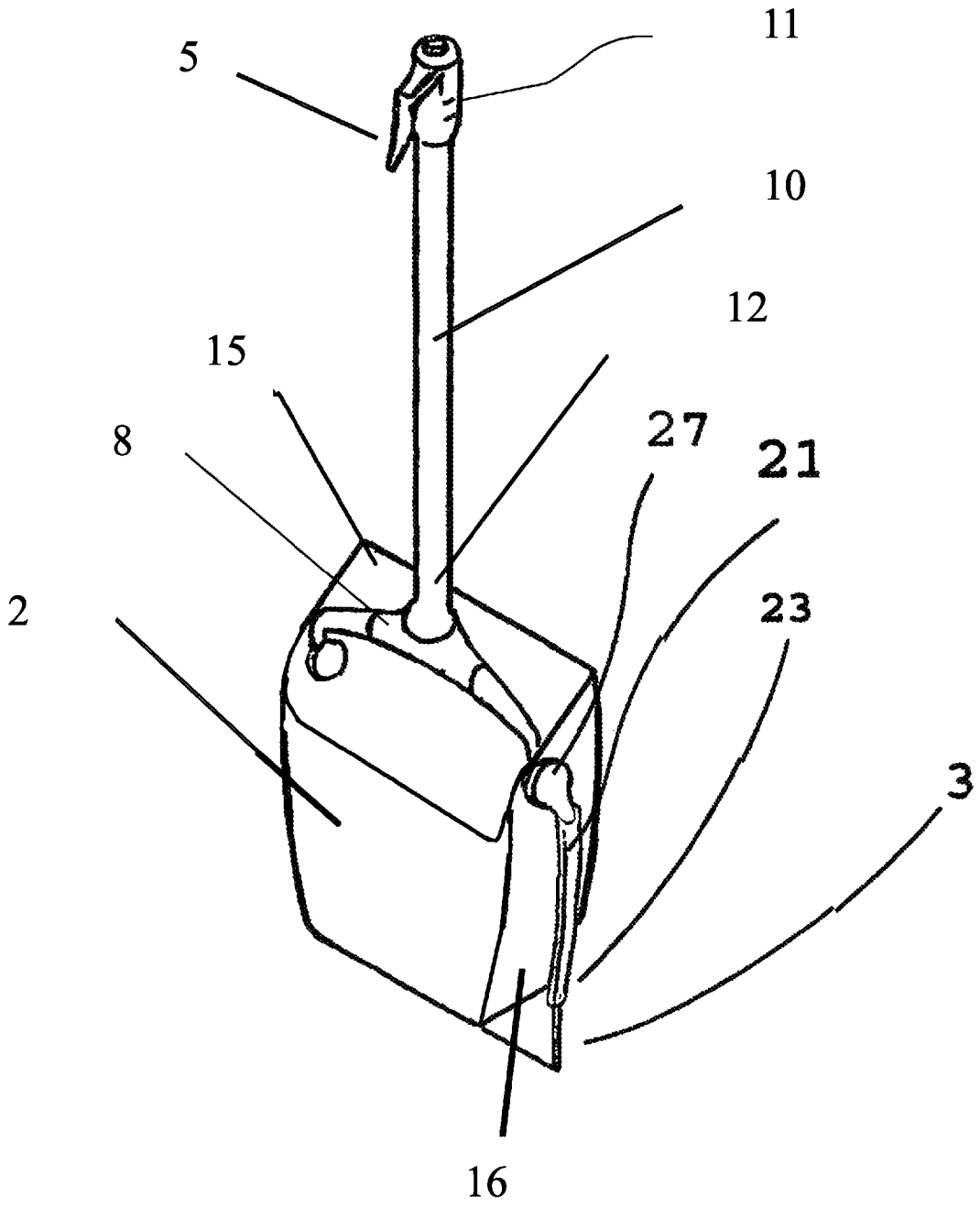
FIG. 1 is a perspective view of a dustpan of the present invention.
Figure 5:
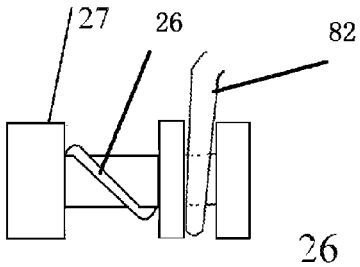
FIG. 5 is a side view of an actuating pin of the present invention.

As shown in FIG. 1 the dustpan has an elongated handle 10, with an upper end 11 and a lower end 12. A dust collecting compartment 2 is attached to the lower end 12 of elongated handle 10, where compartment 2 has a pair of side walls 16, a front opening 15 and a rear door 3. Preferably, the front opening 15 is sloped to allow for easy sweeping of dirt into compartment 2, as is well known in the art. Rear door 3 is preferably attached to at least one of the side walls 16 by a hinge 22, and may also be attached to another side wall by a locking mechanism as shown below.

Elongated handle 10 is hollow, allowing an elongated member 40 to move therein. The upper end of the elongated handle 10 has a trigger control 5. Trigger control 5 is attached to, and directs the movement of, elongated member 40 within elongated handle 10. The lower end of elongated member 40 is connected to at least one actuating arm 8. In a preferred embodiment, resilient spring 45 provides a biasing force against the movement of elongated member 40. For symmetry, there may be a pair of actuating arms 8, but only one need to function as part of the invention. Preferably, actuating arm 8 extends against side wall 16 to provide a detent preventing the pivoting of the compartment 2 relative to handle 10.

When the trigger on control arm 5 is moved relative to handle 10, elongated member 40 moves actuating arm 8, specifically moving an inner end 81 of actuating arm 8. The outer end 82 of actuating arm 8 is attached to an inner end of cylindrical actuating pin/roller 27. In a preferred embodiment, where the movement of elongated member moves the actuating arms 8 in an inward direction, this movement causes a corresponding movement of the cylindrical actuating pin 27 to slide towards center of the compartment 2.

In the embodiment shown in FIGS. 2-5, cylindrical actuating pin 27 has a helical ridge 26 on its external surface. The cross-section of cylindrical actuating pin 27 and the helical ridge engages an aperture 29 in a side wall 16. As cylindrical actuating pin 27 moves laterally with respect to the side wall, the helical ridge 26 causes cylindrical actuating pin 27 to rotate around its axis and within aperture 29.

Through a drive mechanism which is disclosed hereinafter, rear door 3 of compartment 2 opens when cylindrical actuating pin 27 rotates upon activation from trigger control 5, allowing the contents within compartment 2 to empty.

Side actuating arm 21 is preferably an elongated bar, connected at one end to the exterior end of cylindrical actuating pin 27. Rear door 3 of compartment 2 is connected to the other end of side actuating arm 21. Movement of side actuating arm 21 along its length opens or closes rear door 3.

Figures 3A, 3B, 3C:
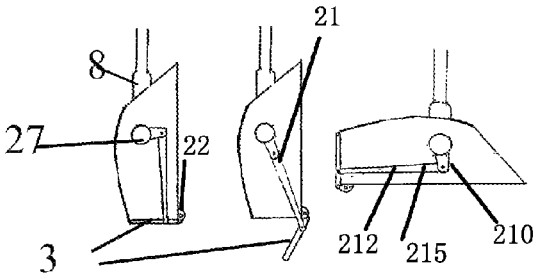
FIGS. 3A to 3C are side view of the present invention, showing the door in different positions and orientations.

In an alternate embodiment as shown in FIGS. 3A-3C, side actuating arm 21 may be divided into two segments 210 and 212, with a pivot joint 215 in between. Upper segment 210 is connected to cylindrical actuating pin 27 and pivot joint 215. Lower segment 212 is connected to pivot joint 215 and rear door 3.

As is known in the art, dust collecting compartment 2 pivots around a pair of pins 27 on each of the side walls. A user would initially sweep dirt into the dust collecting compartment in a horizontal orientation as shown in FIG. 3C, and would lift elongated handle 10, whereby the center of gravity of the dust collecting compartment 2 would cause the compartment 2 to rotate into a vertical orientation as shown in FIG. 3A.

When the trigger control 5 is raised relative to the handle 10, elongated member 40 is moved upward, pulling inner end 81 of actuating arm 8 upward, and causing actuating arm 8 to pivot around pin 28. As actuating arm 8 moves inward, outer end 82 of actuating arm 8 moves in an inward manner, drawing roller 27 inward relative to side wall 16. The helical ridge 26 on the roller 27 is pushed against the channel 200 of the aperture in side wall causing rotation of roller 27. The rotation of roller 27 moves attached side actuating arm 21 in a vertical direction when the dust collecting compartment is oriented as shown in FIG. 1. The movement of side actuating arm 21 can be upward or downward, where the preferred direction of movement is determined by the mechanism used for opening or releasing door 3.

Figure 2:
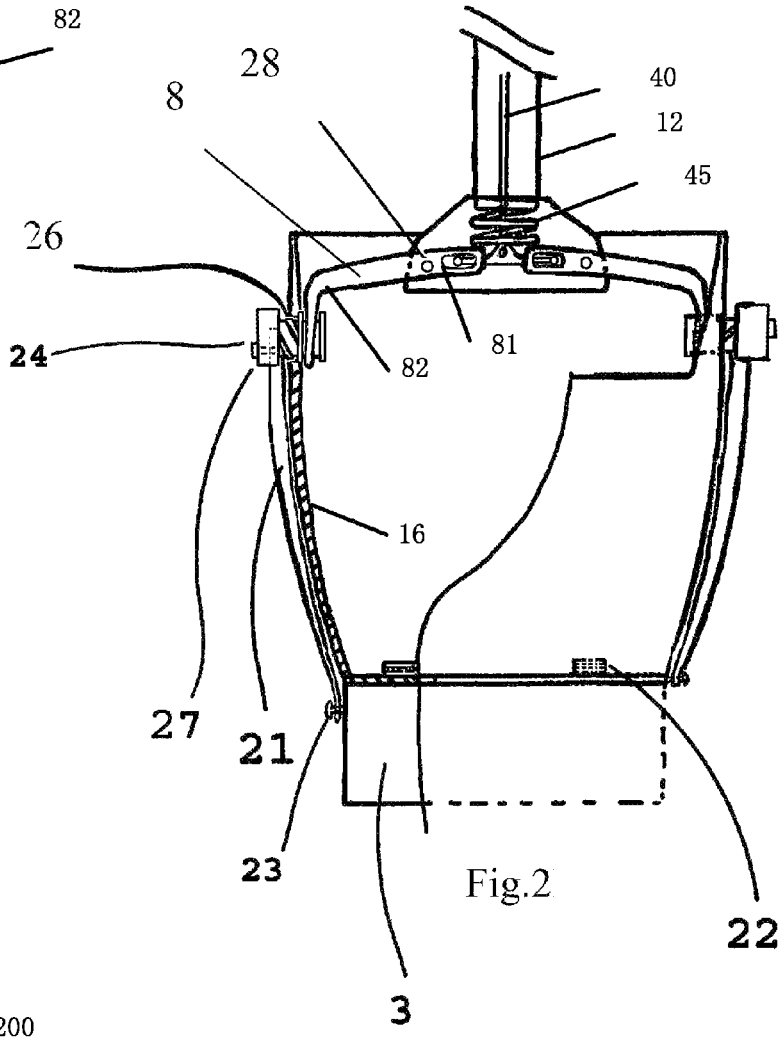
FIG. 2 is a front cut-away view of the present invention.
Figure 4:
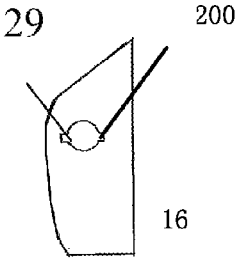
FIG. 4 is a side view of a side wall of the present invention

In one embodiment, as shown in FIG. 2, side actuating arm 21 is connected to door 3 through pin 23. In this embodiment, the desired movement of side actuating arm is downward, and side actuating arm 21 pushes pin 23, which drives door 3 to an open position, allowing debris to fall from compartment 2. Preferably, the helical ridge 26 on the actuating roller 27 is arranged in such a way that when trigger control 5 is not activated by a user, there is resistance to opening of door 3, and the gravity of the content will only cause it to turn towards the limit of the helical ridge 26 and in the other direction in which the door closes, thus it provides a way of locking when trigger control 5 is not activated. When trigger control 5 is not activated, the actuating arms 8 are pressed against the wall of the compartment 2 thus providing a detent against the pivot of the compartment 2 against the elongated handle 10. When trigger control 5 is released from an activated position, preferably a spring or other counterforce drives elongated member 40 in an opposite direction, thereby causing the rotation of cylindrical roller 27 in an opposite direction, moving side actuating arm 21 upward and closing door 3.

FIGS. 6, 7 and 8A-8C disclose an alternate embodiment of the invention. As disclosed above, trigger control 5 is connected to elongated member 40, which is connected in inner end 81 of actuating arm 8. Outer end 82 of actuating arm 8 is connected to pin 37. Pin 37 is connected to side arm 31. The rear door 3 is locked in place with latch 32, which in the preferred embodiment is attached to rear door 3. Lower end 312 of side arm 31 engages latch 32, retaining rear door 3 in a closed or locked position. In a slight variation, latch 32 could be attached to lower end 312 of side arm 31 and engage rear door 3.

As disclosed above, trigger control 5 drives elongated member 40 upward, which in turn causes the movement of actuating arm 8, pivoting around pin 28. End 82 of actuating arm 8 moves inward towards the center of compartment 2. In this alternate embodiment, when end 82 of actuating arm 8 draws roller 37 inward, the horizontal movement of roller 37 moves an upper end 310 of side arm 31 inward toward side wall 16. Side arm 31 is pivoted against side wall 16 by pivot pin 34, and as the upper end of side arm 31 is pulled towards the center of compartment 2, the lower end 312 of side arm 31 moves outwards from side wall 16. The outward movement of lower end 312 releases latch 32, thus allowing rear door 3 to open.

When trigger control arm 5 is released, the lower end 312 of side arm 31 will return to its closed latching position. Unlike the embodiment of FIG. 2, the user may need to direct rear door 3 to its closed position, where it will be latched by latch 32.

FIGS. 8A-8C shows different operational position of the apparatus. FIG. 8C shows the compartment 2 laid flat down as it would be used for cleaning, allowing dirt and objects to be swept into the dustpan. FIG. 8A shows the dustpan in carry position, with rear door 3 closed. FIG. 8B shows the position of the rear door 3 open after the trigger control 5 is activated.

While certain novel features of the present invention have been shown and described, it will be understood that various omissions, substitutions and variations in the forms and details of the device illustrated and in its operation can be made by those skilled in the art without departing from the spirit of the invention.

I claim:

1. A dustpan comprising:

a collecting compartment, the collecting compartment comprising a base, a front opening, two side walls, each side wall having an interior side and an exterior side, where at least one side wall has an aperture extending through from the interior side to the exterior side;

a rear door attached by a hinge to at least one of the side walls or the base;

a cylindrical pivot pin with inner and outer ends, the cylindrical pin having a circular cross section and a cap at the outer end of the cylindrical pin, where the inner end of the cylindrical pin extends through the aperture of the side wall;

an elongated handle, with upper and lower ends and a hollow interior;

an actuator at the upper end of the elongated handle;

an elongated driver extending through the hollow interior of the elongated handle, the elongated driver having a upper end and a lower end, the upper end connected to the actuator;

an elongated actuating arm, with a distal end and a proximal end, where the proximal end of the elongated actuating arm is connected to the lower end of the elongated driver, and the distal end of the elongated actuating arm is connected to the inner end of the pivot pin; and an elongated external arm with proximal and distal ends, the proximal end of the external arm connected to the cap on the pivot pin.

2. The dustpan of claim 1, further comprising:

a channel across an edge of the aperture;

a raised helical ridge on an exterior side of the cylindrical pin, where the raised helical ridge engages the channel of the aperture, converting lateral movement of the cylindrical pin into rotational movement of the cylindrical pin.

3. The dustpan of claim 2, where the actuator moves the elongated driver, which in turn moves the elongated actuating arm, causing lateral movement of the cylindrical pin relative to the side wall, where the helical ridge of the cylindrical pin engaging with the channel of the aperture causes a rotation of the cylindrical pin, and the rotation of the cylindrical pin causes the elongated external arm to open the rear door.

4. The dustpan of claim 1, where the collecting compartment rotates freely at the cylindrical pin relative to the elongated handle.

5. The dustpan of claim 1, further comprising:

a pivot member attached to the exterior side of the side wall, where the elongated external arm pivots at the pivot member.

6. The dustpan of claim 1, further comprising:

a latch securing the rear door in a closed position.

7. The dustpan of claim 5, further comprising:

a latch attached at a distal end of the elongated external arm, the latch capable of securing the rear door in a closed position.

8. The dustpan of claim 1, where the distal end of the external arm is connected to the rear door.

* * * * *